US005226842A

United States Patent [19]

Endo et al.

[11] Patent Number: 5,226,842

[45] Date of Patent: Jul. 13, 1993

[54] FEMALE TERMINAL

[75] Inventors: Takayoshi Endo; Hitoshi Saito, both of Shizuoka, Japan

[73] Assignee: Yazaki Corporation, Japan

[21] Appl. No.: 818,891

[22] Filed: Jan. 10, 1992

[30] Foreign Application Priority Data

Jan. 11, 1991 [JP] Japan ..... 3-000569[

[51] Int. Cl.[5] ..... H01R 13/187

[52] U.S. Cl. ..... 439/843; 439/852

[58] Field of Search ..... 439/842, 843, 844, 849, 439/850, 851, 852, 853, 861

[56] References Cited

U.S. PATENT DOCUMENTS

| | | | |
|---|---|---|---|
| 2,814,025 | 11/1957 | Wade et al. . | |
| 3,120,989 | 2/1964 | Solorow et al. . | |
| 3,370,265 | 2/1968 | Berg | 439/843 |
| 3,383,645 | 5/1968 | Milanese et al. . | |
| 3,617,958 | 11/1971 | Schor | 439/843 |
| 3,781,760 | 12/1973 | Mancini et al. . | |
| 4,168,878 | 9/1979 | Risser et al. . | |
| 4,734,064 | 3/1988 | Knapp et al. . | |
| 4,880,401 | 11/1989 | Shima et al. . | |

FOREIGN PATENT DOCUMENTS

| | | | |
|---|---|---|---|
| 1811276 | 3/1974 | Fed. Rep. of Germany . | |
| 55-37790 | 3/1980 | Japan . | |
| 55-111082 | 8/1980 | Japan . | |
| 63-12169 | 1/1988 | Japan . | |
| 3-106667 | 2/1990 | Japan . | |
| 539811 | 9/1941 | United Kingdom | 439/843 |
| 999817 | 7/1965 | United Kingdom . | |
| 2048581 | 12/1980 | United Kingdom | 439/843 |

*Primary Examiner*—David L. Pirlot

*Attorney, Agent, or Firm*—Wigman, Cohen, Leitner & Myers

[57] ABSTRACT

A female terminal for being connected to a male terminal comprises a terminal body having an opening through which the male terminal is inserted, and a wire connecting part for being connected to a wire. A flexible element is mounted on the terminal body, for pressing the male terminal inserted into the terminal body, against the terminal body. In order that the flexible element is flexed beforehand to facilitate insertion of the male terminal, a pair of engaging projections are integrally formed on the flexible element, while a pair of engaging sections are formed on the terminal body in order that the pair of engaging projections are engaged respectively with the pair of engaging sections.

4 Claims, 5 Drawing Sheets

A, A': INITIAL INSERTING FORCE

B: STABLE CONTACT LOAD

FEMALE TERMINAL

BACKGROUND OF THE INVENTION

The present invention relates to a female terminal having a flexible contact piece at a terminal connecting part.

FIGS. 1 through 3 of the attached drawings show a conventional female-type terminal 1 which is disclosed in Japanese Patent Publication (Kokoku) No. 45-7274. In FIGS. 1 through 3, the female-type terminal 1 comprises a terminal body 7 in which a tubular terminal connecting part 3 having both open end faces and a wiring connecting part 5 are formed integrally, and a flexible contact piece 9 which is a separate part and which is fitted in the terminal connecting part 3 such that an arcuate top 9*a* formed in a bow-like configuration is in contact with a step 3*a* of the connecting part 3.

When a forward end of a male-type terminal 11 is inserted into the terminal connecting part 3 from and through an opening in the end face of the terminal connecting part 3, the forward end of the male-type terminal 11 is abutted against the flexible contact piece 9 which is provided on an inserting path of the male-type terminal 11. When the male-type terminal 11 is pressed into a deep end of the terminal connecting part 7 against the urging or biasing force of the flexible contact piece 9, the latter is flexed. By a restoring force of the flexible contact piece 9, the male-type terminal 11 is pressed. Thus, the male-type terminal 11 is so retained as to be urged against an inner wall of the terminal connecting part 3 by the flexible contact piece 9 so that the male-type terminal 11 is electrically connected to the terminal connecting part 3.

However, the female-type terminal 1 has the following problems. That is, since the flexible contact piece 9 is mounted on the terminal connecting part 3 under a condition that the arcuate top 9*a* of the flexible contact piece 9 is in contact with the step 3*a* of the terminal connecting part 3 as shown in FIG. 2, when the male-type terminal 11 is inserted into the terminal connecting part 3, it is necessary to flex the flexible contact piece 9 immediately after the insertion. For this reason, an inserting force immediately after the male-type terminal 11 has been inserted into the terminal connecting part 3 is high. It is difficult to insert the male-type terminal 11 into the terminal connecting part 3 of the female-type terminal 1. Thus, it is impossible to cope with multiple electrodes of a connector which requires a plurality of female terminals.

SUMMARY OF THE INVENTION

It is therefore an object of the invention to provide a female terminal capable of reducing an initial inserting force of a male terminal into a terminal connecting part of the female terminal.

In order to achieve the above-described object, according to the invention, there is provided a female terminal for being connected to a male terminal, comprising:

a terminal body having an opening through which the male terminal is inserted, and a wire connecting part for being connected to a wire;

a flexible element disposed in the terminal body, for pressing the male terminal inserted into the terminal body, against said terminal body; and means for flexing the flexible element beforehand.

With the arrangement of the invention, since the flexible element is provided on the terminal body under a condition that the flexible element is flexed a predetermined amount, an inserting path for the male terminal formed in the terminal body is widened so that the initial inserting force of the male terminal into the terminal body is reduced without changing a stable contact load. Accordingly, insertion of the male terminal into the terminal body is facilitated. Thus, even if the female terminal is used in a multiple-electrode connector, it is possible to reduce the initial inserting force of the male connector into a fitting hood section of a female connector.

DETAILED DESCRIPTION OF THE PREFERRED EMBODIMENTS

Embodiments of a female terminal according to the invention will next be described.

FIRST EMBODIMENT

Figure 1:
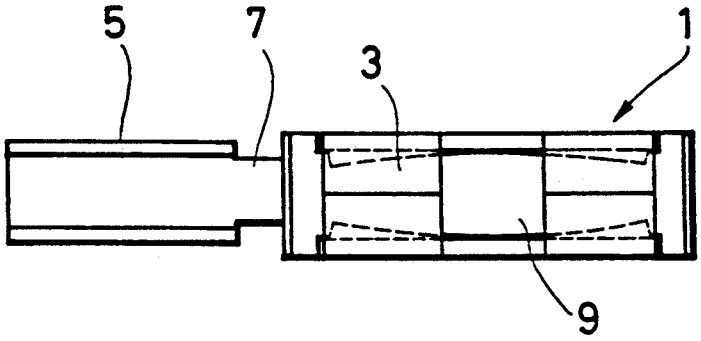
FIG. 1 PRIOR ART
FIG. 1 is a top plan view showing a conventional female-type terminal.
Figure 2:
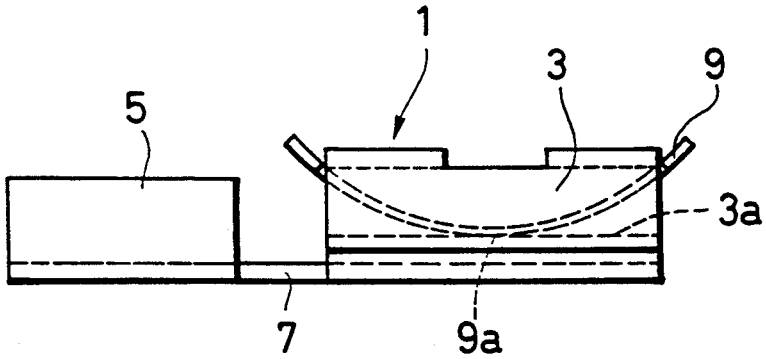
FIG. 2 PRIOR ART
FIG. 2 is a side elevational view showing the conventional female-type terminal.
Figure 3:
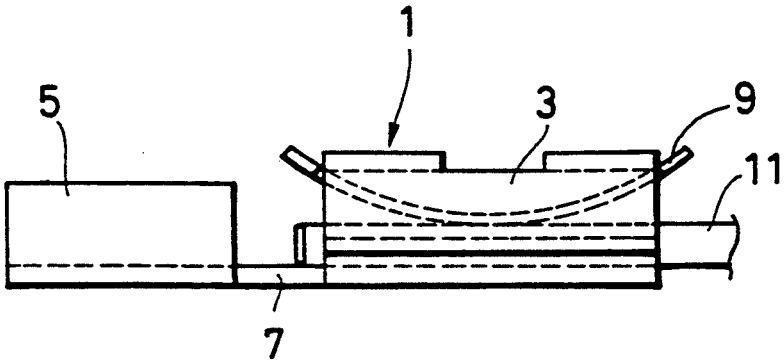
FIG. 3 PRIOR ART
FIG. 3 is a side elevational view showing a condition under which a male-type terminal is inserted into a terminal connecting part of the conventional female-type terminal.
Figure 4:
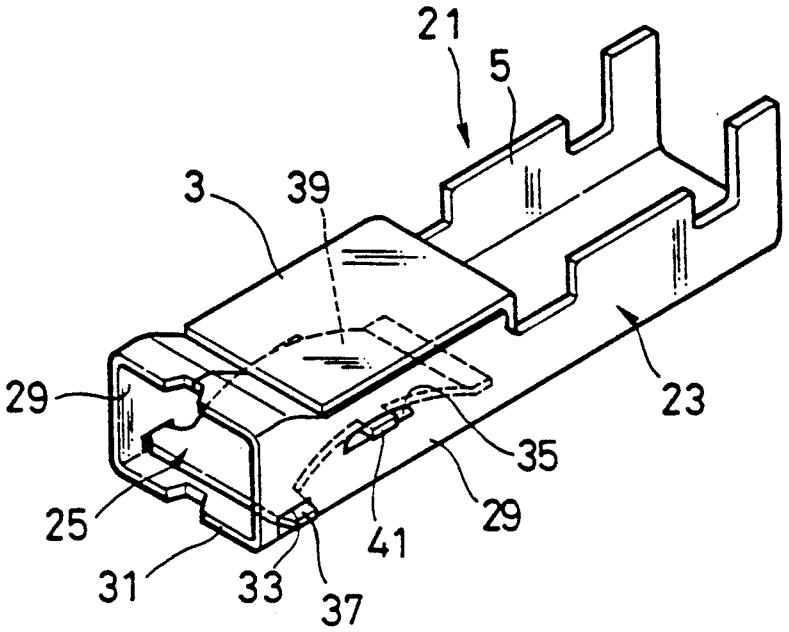
FIG. 4 is a perspective view showing a first embodiment of a female-type terminal according to the invention.

As shown in FIG. 4, a female-type terminal 21 according to the invention comprises a terminal body 23 in which a tubular terminal connecting part 3 and a wire connecting part 5 are formed integrally, and a flexible contact piece 25 which is mounted on the terminal connecting part 3 and which is formed as a separate part.

The terminal connecting part 3 is so formed as to be bent into a box-like configuration in which both ends are open. A male-type terminal 11 is adapted to be inserted from and through an opening 31 (refer to FIG. 9). Further, each of both side walls 29 and 29 of the terminal connecting part 3 is formed with rectangular through-bores 33 and 35 located, respectively, adjacent to the opening 31 and an intermediate upper location. The rectangular through-bore 35 formed at the intermediate upper location is formed longer than the rectangular through-bore 33 formed adjacent to the opening 31.

Figure 5:
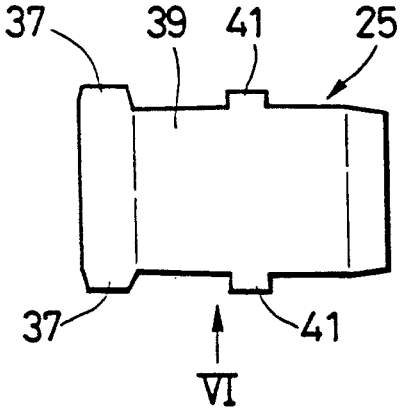
FIG. 5 is a top plan view showing a flexible contact piece according to the first embodiment.
Figure 6:
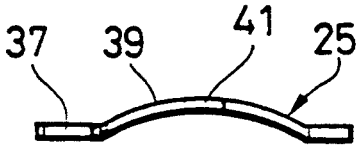
FIG. 6 is a side elevational view showing the flexible contact piece according to the invention, as viewed from a direction of VI in FIG. 5.

As shown in FIGS. 5 and 6, the flexible contact piece 25 is generally in the form of a rectangle, and has one end at which a pair of projections 37 and 37 inserted respectively into the rectangular through-bores 33 are formed respectively at both sides in a lateral or widthwise direction. Furthermore, the flexible contact piece 25 has a portion thereof extending from the intermediate section to the other end thereof, which is bent into a bow-shaped or arcuate configuration, to form a flexible portion 39. At an intermediate section of the flexible portion 39, a pair of preliminary-displacement projections 41 and 41 are provided respectively at both sides in the widthwise direction. The projections 41 and 41 are inserted respectively into the through-bores 35.

Figure 7:
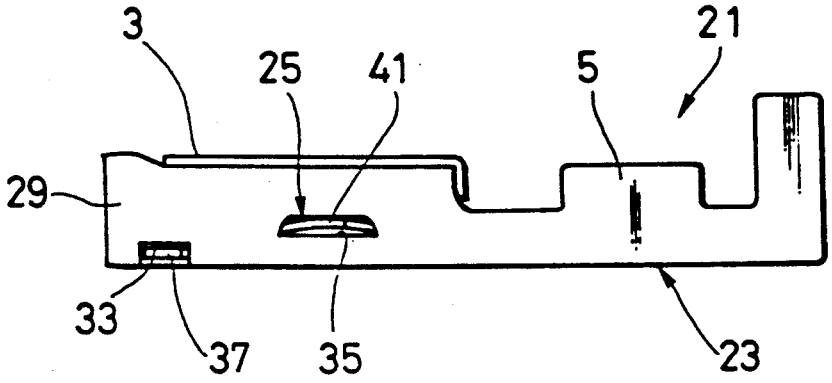
FIG. 7 is a side elevational view showing a relationship between a terminal connecting part and the flexible contact piece.
Figure 8:
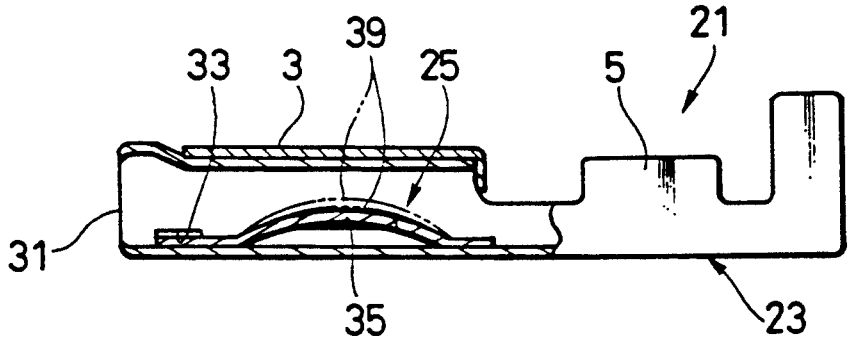
FIG. 8 is a cross-sectional view showing a relationship between the terminal connecting part and the flexible contact piece.

As shown in FIG. 7, the flexible contact piece 25 is flexed a predetermined amount under a condition that the projections 37 and 37 are inserted respectively into the through-bores 33 and 33, the one end of the flexible contact piece 25 is fixed to the terminal body 23, and the preliminary-displacement contact projections 41 and 41 are inserted respectively into the rectangular through-bores 35 and 35. That is, the flexible contact piece 25 is brought to a free configuration, as indicated by the dot-and-dash lines in FIG. 8, under a condition that the flexible contact piece 25 is inserted into the terminal connecting part 3. However, the preliminary-displacement projections 41 are inserted respectively into the rectangular through-bores 35, whereby the flexible contact piece 25 is flexed a predetermined amount and retains the condition.

Inserting operation will next be described in which the male-type terminal 11 is inserted into the terminal connecting part 3 of the female-type terminal 21.

Figure 9:
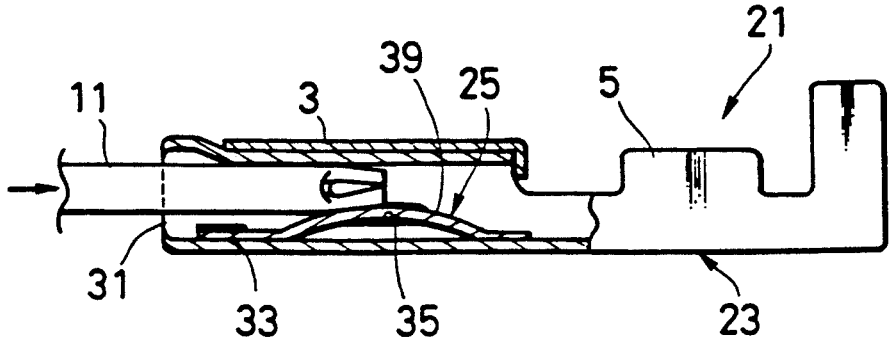
FIG. 9 is a cross-sectional view showing a condition under which the male-type terminal is inserted into the terminal connecting part of the female-type terminal.

As shown in FIG. 9, when a forward end of the male-type terminal 11 is inserted into the terminal connecting part 3 from and through the opening 31 formed in the one end face of the terminal connecting part 3, the forward end of the male-type terminal 11 is abutted against the flexible contact piece 25 provided on an inserting path of the male-type terminal 11. When the male-type terminal 11 is pressed into the deep end of the terminal connecting part 3, the flexible contact piece 25 is flexed to press or urge the male-type terminal 11. Moreover, under this condition, the male-type terminal 11 is inserted toward the deep end of the terminal connecting part 3 against the urging force of the flexible contact piece 25. Thus, the male-type terminal 11 is so retained as to be urged against the inner wall of the terminal connecting part 3 by a restoring force of the flexible contact piece 25, so that the male-type terminal 11 is electrically connected to the terminal connecting part 3.

Figure 10:
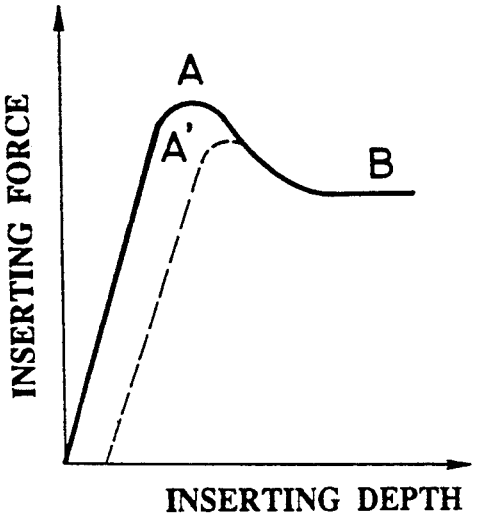
FIG. 10 is a graph showing a relationship between an inserting depth of the male-type terminal into the terminal connecting part and an inserting force.

At this time, the flexible contact piece 25 is flexed beforehand, and an inserting path of the male-type terminal 11 is widened which is defined between the flexible contact piece 25 and the inner wall of the terminal connecting part 3. Accordingly, it is possible to reduce the inserting force to one less than that of the conventional female-type terminal. That is, as indicated by the solid line in FIG. 10, a conventional initial inserting force A is maximized immediately after the male-type terminal 11 has been inserted into the terminal connecting part 3. In the case of the invention, however, a position where an initial inserting force A' is maximized is brought to a rearward position where the male-type terminal 11 is inserted into the terminal connecting part 3 through a certain degree. Accordingly, the initial inserting force A' is reduced less than the conventional initial inserting force A. It will suffice that a force flexing the flexible contact piece 25 is reduced in an initial stage of fitting. Thus, it is possible to easily insert the male-type terminal 11 into the terminal connecting part 3 with a small inserting force at the initial stage of fitting.

In connection with the above, after the male-type terminal has initiated predetermined stroke fitting, the male-type terminal is subjected to a stable contact load B similarly to the conventional one so that it is possible to produce a predetermined electric contact.

Thus, in the case where a plurality of female-type terminals 21 are used in a connector of multiple electrodes, it is possible to reduce the initial inserting force of the male-type connector into the fitting hood section of the female-type connector. Further, since the female-type terminal 21 according to the embodiment is arranged such that one end of the flexible contact piece 25 is fixedly mounted on the terminal connecting part 3, while the other end thereof is a free end, the flexible contact piece 25 is liable to be flexed. Thus, rattling or shaking does not also occur.

SECOND EMBODIMENT

Figure 11:
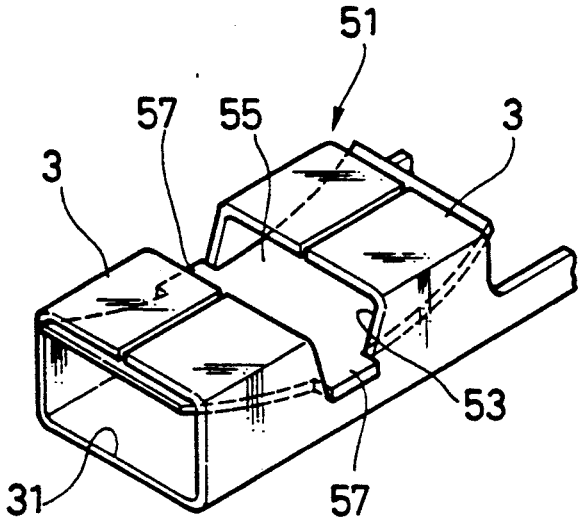
FIG. 11 is a perspective view showing a female-type terminal according to a second embodiment of the invention.
Figure 12:
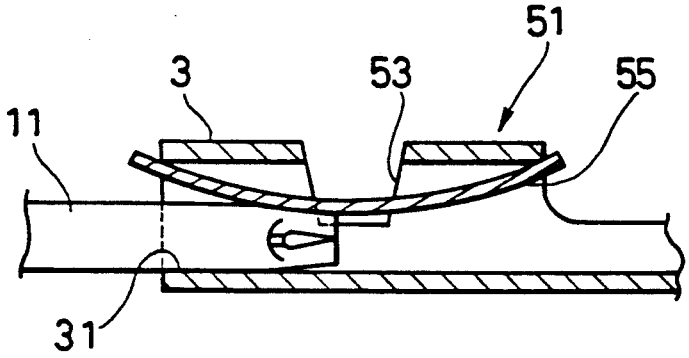
FIG. 12 is a cross-sectional view showing a condition immediately after the male-type terminal has been inserted into the terminal connecting part.
Figure 13:
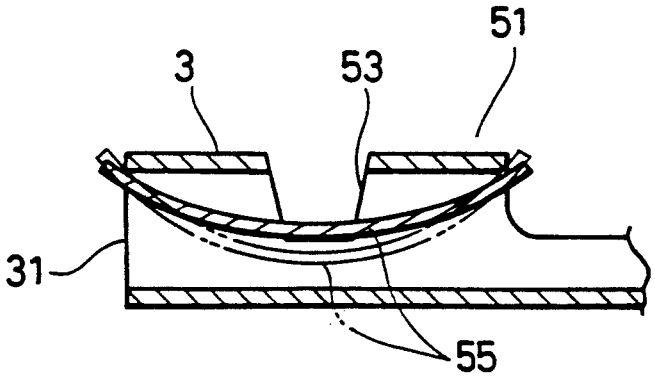
FIG. 13 is a cross-sectional view showing a condition relationship between a terminal connecting part and a flexible contact piece.

A second embodiment will next be described with reference to FIGS. 11 through 13. As shown in FIG. 11, a saddle 53 is formed at an intermediate section of a terminal connecting part 3 of a female-type terminal 51 according to the embodiment. On the other hand, a flexible contact piece 55 according to the invention is in the form of a bow as a whole, and has an intermediate section formed with a pair of projections 57 and 57 projecting in a widthwise direction. The flexible contact piece 55 is arranged such that, under a condition that the flexible contact piece 55 is flexed a predetermined amount, the projections 57 are engaged with the saddle 53.

When the forward end of the male-type terminal 11 is inserted into the terminal connecting part 3 of the female-type terminal 51, the forward end of the male-type terminal 11 is abutted against the flexible contact piece 55 which is provided on the inserting path of the male-type terminal 11. When the male-type terminal 11 is pushed into an deep end of the terminal connecting part 3, the flexible contact piece 55 is flexed to urge the male-type terminal 11. Under this condition, the male-type terminal 11 is further inserted into the deep end of the terminal connecting part 3 against the urging force of the flexible contact piece 55. Thus, the male-type terminal 11 is urged against the inner wall of the terminal connecting part 3 by the flexible contact piece 55 and is retained so that the male-type terminal 11 is electrically connected to the terminal connecting part 3.

According to the embodiment, since the flexible contact piece 55 is provided on the terminal connecting part 3 under such a condition that the flexible contact piece 55 is flexed a predetermined amount, the inserting path of the male-type terminal 11 is widened so that it is possible to reduce the inserting force. Further, in the embodiment, since the flexible contact piece 55 has both ends thereof which are free and the both ends of the flexible contact piece 55 are moved equally under the flexed condition, the flexible contact piece 55 is not moved in the inserting direction of the male-type terminal 11. Thus, it is possible to prevent rattling or shaking from occurring.

In connection with the above, each of the above-described embodiments is arranged such that the flexible contact piece which is a separate part is provided on the terminal connecting part of the female-type terminal. However, the arrangement may be such that the flexible contact piece is applied to a female-type terminal in which the flexible contact piece is formed in bending integrally with the female-type terminal body. Further, in each of the above-described embodiments, an example has been illustrated in which the terminal connecting part is a female-type terminal in the form of a box-like configuration. However, the invention is not limited to these specific embodiments. The invention may be applied to a female-type terminal in which the terminal connecting part is in the form of a tube.

What is claimed is:

1. A female terminal for being connected to a male terminal, comprising:

a terminal body having an opening through which said male terminal is inserted in an inserting direction, and a wiring connecting part for being connected to a wire;

a flexible element disposed in said terminal body, for pressing against said male terminal inserted into said terminal body; and stop means provided in said terminal body for restraining a center portion of said flexible element in a preloaded condition prior to the insertion of said male terminal into said terminal body so as to reduce the initial insertion force of said male terminal therein, and wherein said center portion is restrained against substantial deflection in a flexing direction away from said male terminal.

2. A female terminal for being connected to a male terminal, according to claim 1, wherein said flexible element is comprised of a leaf spring having a curved section at both ends, wherein said restraining means comprises a pair of fixing projections formed integrally with one of the ends of said leaf spring, a pair of preliminary-displacement projections formed on the curved section of said leaf spring at said center portion thereof, a pair of fixing engaging sections formed in said terminal body for being engaged respectively with said pair of fixing projections, and a pair of preliminary-displacement engaging sections formed in said terminal body for being engaged respectively with said pair of preliminary-displacement projections, each of said projections and each of said engaging sections being so arranged as to preload said flexible element so as to reduce the initial insertion force of said male terminal into said terminal body after said flexible element is mounted on said terminal body.

3. A female terminal for being connected to a male terminal, according to claim 1, wherein said flexible element is comprised of a leaf spring having a curved section at both ends, and said means for flexing said flexible element prior to the insertion of said male terminal into said terminal body comprises an abutting portion formed on the both ends of said flexible element to abut against said terminal body, a pair of engaging projections formed on the curved section of said flexible element, and a pair of engaging sections formed on said terminal body for being engaged respectively with said pair of engaging projections, said engaging projections and said engaging sections being so arranged as to urge said abutting portion against said terminal body and to flex said flexible element so as to reduce the initial insertion force of said male terminal into said terminal body after said flexible element is mounted on said terminal body.

4. A female terminal for being connected to a male terminal according to claim 1, wherein said restraining means comprises a pair of laterally-extending projections provided at said center portion of said flexible element, and a pair of recesses formed in said terminal body for receiving said projections.

* * * * *